United States Patent [19]

Hamrick

[11] 4,407,360

[45] Oct. 4, 1983

[54] BOREHOLE WATER PUMPING SYSTEM WITH SANDTRAP

[75] Inventor: Joseph T. Hamrick, Roanoke, Va.

[73] Assignee: Well-Pack Systems, Inc., Fort Worth, Tex.

[21] Appl. No.: 330,688

[22] Filed: Dec. 14, 1981

[51] Int. Cl.[3] ..... E21B 43/02

[52] U.S. Cl. ..... 166/68; 166/105.1; 166/105.4

[58] Field of Search ..... 166/369, 105, 68, 68.5, 166/105.1, 105.3, 105.4; 415/121 G, 168, 501

[56] References Cited

U.S. PATENT DOCUMENTS

| | | | |
|---|---|---|---|
| 1,519,042 | 12/1924 | Osborne | 166/105.4 |
| 1,698,444 | 1/1929 | Lybyer | 166/105.4 |
| 3,300,983 | 1/1967 | Dougherty et al. | 415/501 |
| 3,624,822 | 11/1971 | Carle et al. | 166/105.5 |
| 4,223,724 | 9/1980 | Levoni et al. | 166/68 |

*Primary Examiner*—William F. Pate, III
*Assistant Examiner*—William P. Neuder
*Attorney, Agent, or Firm*—Wofford, Fails & Zobal

[57] ABSTRACT

A water pump located in a cased borehole has a lower inlet and an upper outlet which is coupled to a pipe means that extends to the surface. At the surface, the borehole is coupled to a water delivery pipe and the pipe means is coupled to a conduit having a sand dump valve. An opening is formed through the pipe means near the outlet of the pump. A packer is located between the inlet of the pump and said opening. A sandtrap is located in said opening for trapping sand flowing with water from the pump outlet through the opening and upward through the annulus between the pipe means and borehole wall. In order to remove the sand from the sandtrap, the sand dump valve is opened to allow sand trapped by the sandtrap to flow upward with water through said pipe means and to be discharged through said conduit means.

3 Claims, 1 Drawing Figure

BOREHOLE WATER PUMPING SYSTEM WITH SANDTRAP

BACKGROUND OF THE INVENTION

Water lift heights for water wells vary from a few feet to hundreds of feet in many areas of the United States. The pumps employed normally are submerged multi-stage centrifugals and are referred to as turbine pumps. They normally are driven by line shafts extending from the top of the well to the pump. Spider supports and bearings at spaced intervals hold the line shaft inside of and concentric with a column pipe which serves as a conduit from the pump to the surface.

There is a sand problem with many wells in the high plains in Texas. Many farmers are employing smaller column pipes to increase the water velocity to clean the sand from above the pump. The sand gets trapped in the irrigation spray nozzles, however, and must be cleaned out periodically. The smaller column pipes also greatly increase the energy usage.

SUMMARY OF THE INVENTION

It is an object of the present invention to provide a system for pumping water from subsurface formations to the surface through a cased borehole which avoids or minimizes the above problems.

It is a further object of the present invention to provide a borehole water pumping system having a sandtrap for trapping sand flowing upward through the borehole for subsequent removal.

The system comprises pump means located in a cased borehole and having lower inlet means and upper outlet means. A pipe means is coupled to said outlet means of said pump means and extends to the surface through the cased borehole for providing a flow path to the surface. Said pipe means is spaced inward from the wall of said cased borehole defining an annulus between said pipe means and the wall of the cased borehole for the flow of water. Means is provided for operating said pump means. Aperture means is formed through said pipe means in the borehole relatively near said pump means. Annular packer means is located in the borehole between said inlet means of said pump means and said aperture means for engaging the wall of the cased borehole. Sandtrap means is provided comprising structure extending from the interior of said pipe means outward beyond said pipe means into said annulus with its outer periphery spaced inward from the wall of the cased borehole. Said structure divides said aperture means into lower and upper portions. The lower portion of said aperture means provides a flow path from said pipe means to said annulus. Said structure of said sandtrap means causes water flowing through said lower portion of said aperture means to flow outward into said annulus and upward between the outer periphery of said structure of said sandtrap means and the wall of the cased borehole. The upper portion of said aperture means provides a re-entry flow path from said annulus into said pipe means. Water discharge means at the surface is coupled to said annulus. Conduit means at the surface is coupled to said pipe means. Valve means is coupled to said conduit means and is adapted to be opened to allow sand trapped by said sandtrap means to flow upward with water through said pipe means and to be discharged through said conduit means.

DESCRIPTION OF THE PREFERRED EMBODIMENT

Figure 1:
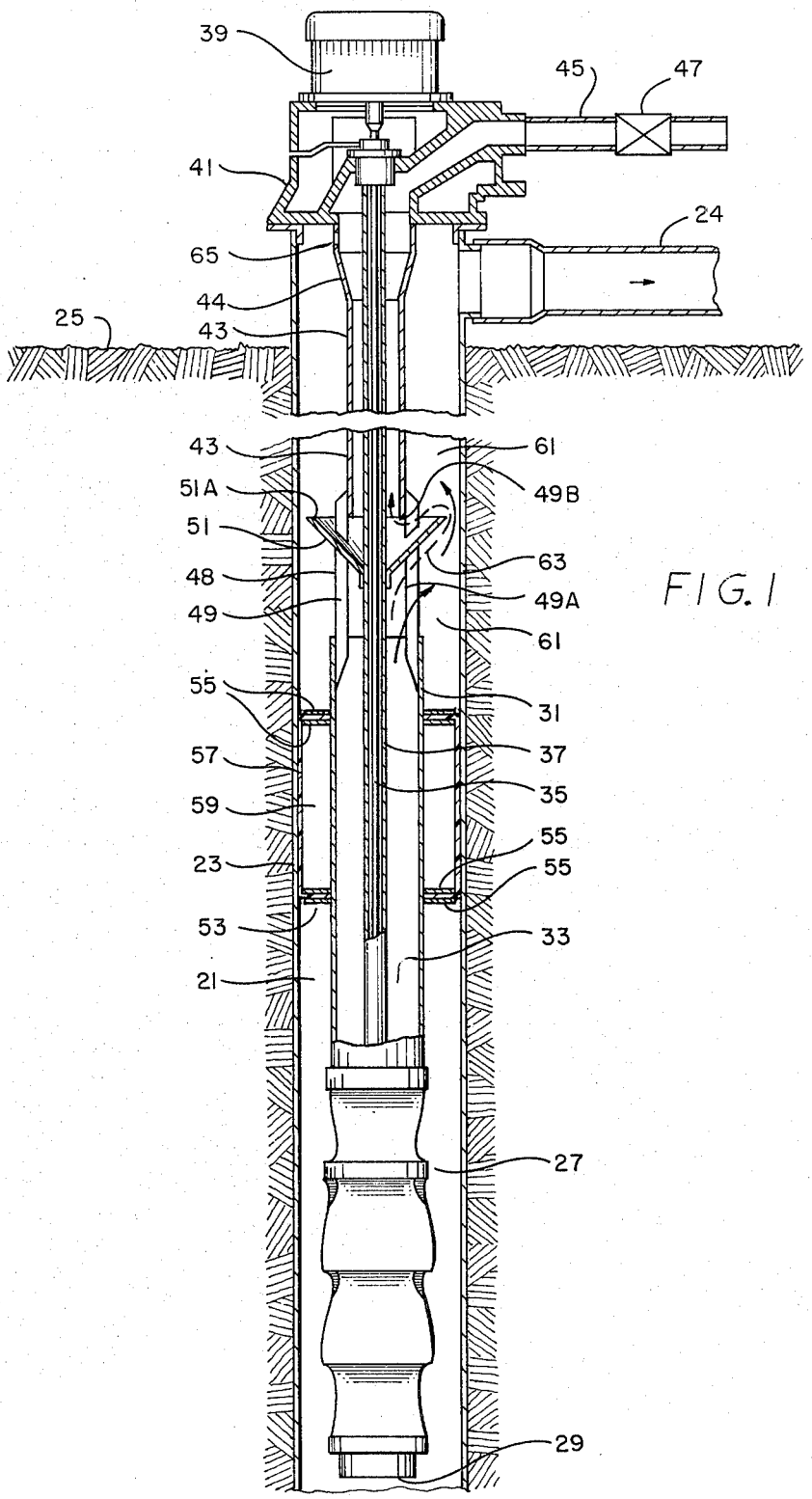
FIG. 1 illustrates the system of the present invention with the lower portion located in a borehole.

Referring now to the drawing, there is disclosed a borehole 21 lined with steel casing 23 which extends from the surface 25 to a water bearing formation, not shown. At the surface, a water delivery pipe 24 is coupled to the casing 23. Pipe 24 may be used to discharge water directly into a ditch or it may be coupled to suitable sprinklers for overhead irrigation. In the borehole, casing 23 may terminate just above the water bearing formation or have perforations formed therethrough. Located in the borehole near the level of the water bearing formation is a centrifugal pump 27 also referred to as a turbine pump. The pump has a lower inlet 29 and a relatively short upper outlet conduit 31 coupled around an upper outlet 33. A line shaft 35 is coupled to the pump 27 and extends upward through a center pipe 37 to a power system 39 located at the surface for rotating the shaft 35 to drive the pump. Power system 39 may be a gasoline or diesel powered engine or an electric motor supported by surface assembly 41. A column pipe 43 is coupled to the upper end of outlet conduit 31 and extends to the surface to a conduit 44 which is coupled to the surface assembly 41. A conduit 45 is coupled to the surface assembly 41 in fluid communication with the conduit 44. A sand dump valve 47 is coupled to the conduit 45.

The lower end of column pipe 43 is coupled to the upper outlet conduit 31 by way of a plurality of spaced apart plate members 48 defining and open portion 49 between the plate members 48 and between the upper end of outlet conduit 31 and the lower end of column pipe 43. A conical shaped member 51 defining a sandtrap is coupled to the center pipe 33 at the open portion 49 and extends outward into the borehole with its outer edge 51A spaced inward from the inner wall of the casing 23.

An inflatable packer 53 is installed around the outer conduit 31. It comprises upper and lower pairs of annular rings 55 connected to the outlet conduit 31 for holding a resilient and expandable member 57 which may be formed of neoprene reinforced with fibrous material such as nylon to prevent it from failing under torsional load. The annular rings 55 of each pair are bolted together with the top and bottom portions of the member 57 located between the upper and lower pairs of rings 55 respectively to form an air-tight interior chamber 59. A tubular member (not shown) is coupled to the interior 59 of the packer and extends to the surface whereby the packer may be inflated with air when the system is installed in the borehole and operated and deflated when it is desired to remove the system from the borehole. The packer 53 may be of the type disclosed in pending U.S. patent application Ser. No. 41,797, filed May 23, 1979.

The pump 27 is located in the borehole by lowering the pump 27 and packer 53 connected to a section of the column pipe 43 and to a section of the center pipe 37 and line shaft 35. A section of the packer inflating tube coupled to the packer also is lowered. As the sections are lowered another section of column pipe 43, center pipe 37, line shaft 35, and packer inflating tube are assembled to the first sections and lowering continues in this manner with the next sections being assembled to the last sections until the pump has been lowered to the desired position in the borehole. Suitable supports may be employed to maintain the column pipe 43 concentric with the casing 23 of the borehole 21. The packer 53 then is inflated with air to form a seal between the packer member 57 and the inside wall of the casing 31 to prevent leakage of water back into the well below the packer 53 and to prevent the pump body from rotating.

When pumping for irrigation purposes, sand dump valve 47 is closed. Upon operation of pump 27, water flows through the pump 27 by way of its inlet 29 and outlet 33 and upward through the outlet conduit 31. During irrigation, water flows through the lower portion 49A of the opening 49 into the annulus 61, upward between the outer edge 51A of the sandtrap 51 and the casing wall and upward through the annulus 61 to the delivery pipe 24 where it is discharged into a ditch or through sprinkler spray nozzles. Above the sandtrap 51, the water velocity slows and the sand in the water falls back into the cone of the sandtrap 51.

Assume that the delivery pipe 24 is connected to a sprinkler system. In order to clean the sand from the sandtrap 51, the sand dump valve 47 is opened. When this occurs, water will flow also inward through the upper portion 49B of the opening 49 as shown by arrow 63 and into and upward through the column pipe 43 and outward through the conduit 45 and sand dump valve 47. The back pressure from the sprinkler system is sufficient such that the sand will be sucked up from the sandtrap 51, upward through the column pipe 43 and outward through the conduit 45 and sand dump valve 47. After the sand is removed from the sandtrap 51, the valve 47 is closed.

Assume the delivery pipe 24 is employed for discharging water into a ditch. In order to clean the sand from the sand trap 51, the end of the delivery pipe 24 will be capped or closed and the valve 47 opened. This causes water to flow upward through the column pipe 43 which sucks the sand in the sand trap 51 upward through the column pipe 43 and discharges it through the conduit 45 and valve 47. After the sand is removed from the sandtrap 51, the valve 47 is closed.

The outlet conduit 31 may have a relatively smaller diameter than that shown to ensure sufficient water velocity from the pump outlet 33 to the sandtrap 51 to prevent sand from falling back to the pump. The sandtrap 51 also will be located close to the outlet 33 of the pump where the water velocity is high.

Aperture 65 is a bypass port employed to allow a small amount of water to pass through the column pipe 43 at all times to cool the line shaft bearings which are located in center pipe 37 but are not shown.

Although the pump in the present application has been described as being driven with a line shaft 35 operated at the surface by a power system 39, it is to be understood that the pump could be driven with a submersible electric motor located in the borehole.

I claim:

1. A system for pumping water from sub-surface formations to the surface through a cased borehole, comprising:

pump means located in the borehole and having lower inlet means and upper outlet means, a pipe means coupled to said outlet means of said pump means and extending to the surface through the cased borehole for providing a flow path to the surface, said pipe means being spaced inward from the wall of said cased borehole defining an annulus between said pipe means and the wall of the cased borehole, means for operating said pump means, aperture means formed through said pipe means in the borehole relatively near said pump means, annular packer means located in the borehole between said inlet means of said pump means and said aperture means for engaging the wall of the cased borehole, sandtrap means comprising structure extending from the interior of said pipe means outward beyond said pipe means into said annulus with its outer periphery spaced inward from the wall of the cased borehole, said structure dividing said aperture means into lower and upper portions, the lower portion of said aperture means providing a flow path from said pipe means to said annulus, said structure causing the water flowing through said lower portion of said aperture means to flow outward into said annulus and upward between the outer periphery of said structure and the wall of the cased borehole, the upper portion of said aperture means providing a re-entry flow path from said annulus to said pipe means, water discharge means at the surface coupled to said annulus, conduit means at the surface coupled to said pipe means, and valve means coupled to said conduit means adapted to be opened to allow sand trapped by said sandtrap means to flow upward with water through said pipe means and to be discharged through said conduit means.

2. The system of claim 1, wherein:

said structure of said sandtrap means is conical in shape.

3. The system of claim 1, wherein:

said structure of said sandtrap means extends from the interior of said pipe means outward through said aperture means.

* * * * *